US005454931A

United States Patent [19]

Lauve

[11] Patent Number: 5,454,931

[45] Date of Patent: Oct. 3, 1995

[54] PORTABLE GUN RACK

[76] Inventor: Jules Lauve, Jr., P.O. Box 897, Galveston, Tex. 77553

[21] Appl. No.: 246,172

[22] Filed: May 19, 1994

[51] Int. Cl.[6] ..... B65D 85/00

[52] U.S. Cl. ..... 206/317; 312/216; 312/257.1; 312/265.5; 211/64

[58] Field of Search ..... 206/317; 312/216, 312/221, 219, 220, 257.1, 265.5; 211/4, 64; 220/4.33, 681

[56] References Cited

U.S. PATENT DOCUMENTS

| | | | |
|---|---|---|---|
| D. 157,241 | 2/1950 | Del Pozo . | |
| D. 162,207 | 2/1951 | Mettenleiter . | |
| D. 225,706 | 1/1973 | McCollum . | |
| D. 241,392 | 9/1976 | Taylor . | |
| D. 248,347 | 7/1978 | McCollum . | |
| D. 256,303 | 8/1980 | Rieman . | |
| D. 272,787 | 2/1984 | Rumbaugh . | |
| D. 275,534 | 9/1984 | Halverson . | |
| 1,951,255 | 3/1934 | Parker . | |
| 2,158,623 | 5/1939 | Fischbacher . | |
| 2,623,639 | 12/1952 | Levy . | |
| 2,855,108 | 10/1958 | Haapala . | |
| 2,958,422 | 11/1960 | Caloiero et al. . | |
| 3,655,087 | 4/1972 | Luisada | 220/681 |
| 3,664,163 | 5/1972 | Foote | 211/64 |
| 3,800,939 | 4/1974 | Cornelius | 206/813 |
| 3,809,278 | 5/1974 | Csumrik | 220/681 |
| 4,113,107 | 9/1978 | Jaeger | 211/64 |
| 4,132,315 | 1/1979 | Young . | |
| 4,181,221 | 1/1980 | Tennant . | |
| 4,288,132 | 9/1981 | Znamirowski et al. | 312/265.5 |
| 4,461,385 | 7/1984 | Clouser . | |
| 4,796,762 | 1/1989 | Law . | |
| 4,986,427 | 1/1991 | Law et al. . | |
| 5,265,950 | 11/1993 | Atkinson . | |

*Primary Examiner*—David T. Fidei
*Attorney, Agent, or Firm*—Gunn & Associates

[57] ABSTRACT

A portable gun rack comprises an open-faced enclosure with a securing clip or a plurality of securing clips to securely grasp one or more weapon barrels and a lower horizontal support with low retaining barriers to provide lateral support for gun butts. The gun rack may be releasably latched or otherwise coupled to a base that is mounted to a vehicle or other solid, movable or stationary object. The gun rack preferably includes means to releasably latch the rack in a horizontal or vertical orientation. The gun rack may also include a water-tight cover that may be releasably latched to the enclosure to further protect weapons from the elements. The cover may conveniently be provided with a carrying handle so that the rack can be unlatched from a base in a vehicle or residence carried to a site for use of the weapon while maintaining protection for the enclosed weapon.

18 Claims, 1 Drawing Sheet

PORTABLE GUN RACK

FIELD OF THE INVENTION

The present invention relates generally to the field of apparatus for securing weapons and, more particularly, a portable rack that securely holds rifles, shotguns, or both.

BACKGROUND OF THE INVENTION

Hunters and other sportsmen, such as skeet and trap shooters, often transport weapons with them from home to a site for shooting. Hunters also carry weapons from a hunting lodge or cabin to a hunting area or stand. In getting to the hunting area, hunters may have to traverse very rough terrain while transporting their weapons. Rifles and shotguns are consequently frequently carried in horizontal racks that rely upon gravity to support and secure the weapons. Other weapons may even be carried loose on a floorboard of a pickup or a car or even in the trunk of a car or the bed of a pickup.

Carrying a weapon around in this manner presents a number of problems. The rifle or shotgun is a precision instrument with many fine tolerance parts that can be damaged by mechanical jarring while being transported in a vehicle. A high-power rifle is frequently fitted with a scope, another fine precision instrument that is also subject to damage from being jostled in a vehicle. The jolting of the weapon can also upset the sighting of the scope, which often cannot be easily and accurately corrected in the field.

For safety reasons, a weapon should always be assumed to be loaded. Unfortunately, weapons are often transported in a loaded condition, even when carried around loose in a vehicle. This can result in inadvertent premature discharge of the weapon with the resultant injury, property damage, or even loss of life.

A number of gun cabinets have heretofore been proposed for the safe storage of guns in a stationary location. For example, Atkinson, U.S. Pat. No. 5,265,950, suggests a locking apparatus for a wooden cabinet. Unfortunately, cabinets such as the one shown by Atkinson do not provide the support necessary for a gun or rifle during transport and is not adaptable for this use. Further, Atkinson is concerned with the security of the weapon, not protection of the weapon from mechanical jarring which may be encountered when delivering the weapon from place to place.

Thus, there remains a need for a portable carrying apparatus suitable for carrying guns from one stationary location to another. Such an apparatus should securely grasp the weapons against vibration and mechanical jarring while providing a easy release of the weapon from the carrying apparatus. Preferably, the carrying apparatus also provides a means of securing the apparatus to a base securely mounted within a vehicle and just as easily to a stationary mount in a home or hunting lodge. The carrying apparatus should also be simple in construction to minimize cost. Finally, the carrying apparatus should provide a structure for the safe transport of weapons contained therein and be adaptable for manual carrying when not secured within a vehicle or residence.

SUMMARY OF THE INVENTION

The present invention addresses these and other deficiencies of the prior art by providing a portable gun rack. The gun rack comprises an open-faced enclosure with a securing clip or a plurality of securing clips to securely grasp one or more weapon barrels and a lower horizontal support with low retaining barriers to provide lateral support for gun butts. The gun rack of the present invention may be releasably latched or otherwise coupled to a base that is mounted to a vehicle or other solid, movable or stationary object. The gun rack preferably includes means to releasably latch the rack in a horizontal or vertical orientation. The gun rack may also include a water-tight cover that may be releasably latched to the enclosure to further protect weapons from the elements. The cover may conveniently be provided with a carrying handle so that the rack can be unlatched from a base in a vehicle or residence carried to a site for use of the weapon while maintaining protection for the enclosed weapon.

In another preferred embodiment, the base is bolted to a vehicle or other stationary or movable foundation and the rack removably mounts to the base with one or more wing-nuts. The base provides a lip that the rack slides under and the back of the rack bolts to the base for quick and easy removal of the rack from the base by use of bolts and wing-nuts.

These and other objects and features of the present invention will be apparent to those of skill in the art from the detailed description in view of the drawing figures.

DETAILED DESCRIPTION OF A PREFERRED EMBODIMENT

Figure 1:
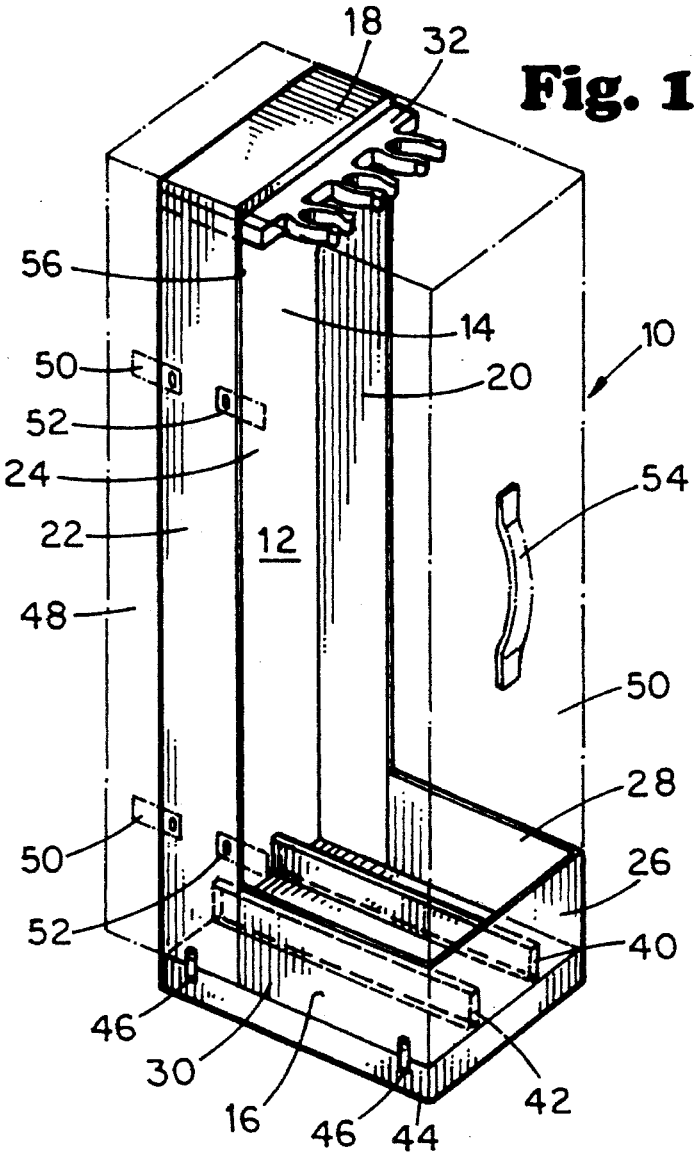
FIG. 1 is a perspective view of a portable gun rack of the present invention.

FIG. 1 depicts a portable gun rack of the present invention, designated generally as element 10. The rack 10 comprises an open-faced enclosure 12 that includes a back 14 and a bottom 16. The back 14 includes a top wall 18, a pair of opposed side walls 20, 22, and a back-plate 24. The bottom 16 includes a front wall 26, a pair of opposed side walls 28, 30, and a bottom-plate. These descriptive terms have been chosen for the vertical arrangement of the rack depicted in FIG. 1 and those of skill in the art will recognize the functions of these components if the rack is arranged horizontally.

Figure 2:
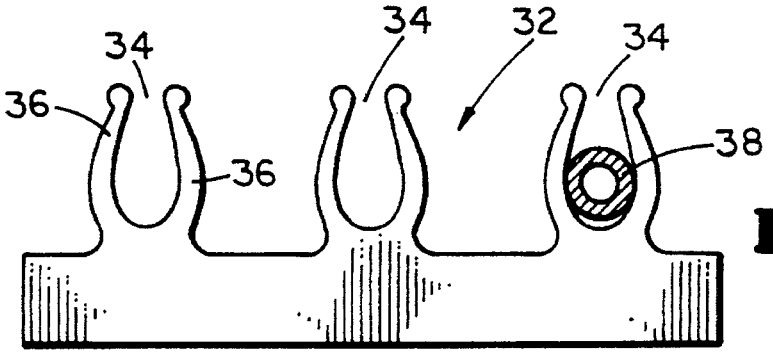
FIG. 2 is a top, detail view of a securing clip that is a part of the gun rack of FIG. 1.

Attached to or integrally formed with the back 14 is a securing clip member 32. The clip member 32 is shown in greater detail in the top view shown in FIG. 2. The clip member comprises one or more clips 34 and each clip 34 is formed by a pair of tines 36. The tines 36 grasp a barrel 38 of a weapon when the weapon is inserted into the rack of the present invention.

The clip member 32 is preferably injection molded as a separate component of the rack and made of a tough polymeric material. However, the clip member 32 may be formed as an integral, structural member of the rack. As shown in FIG. 1, the clip member 32 is preferably mounted adjacent the top wall 18 to provide additional mechanical support for the clip member 32 but the clip member may be placed anywhere along the side walls 20, 22 so long as it is far enough from the bottom 16 to grasp the barrel 38 when the weapon is inserted in the rack. If the clip member 32 is placed too near the bottom 16, it may abut the stock of the weapon, rather than the barrel. In fact, the clip member 32 may itself form the top wall 18.

Mounted or formed as an integral part of the bottom 16 are a plurality of barriers 40, 42, for embodiments of the rack designed to carry more than one weapon. No barrier is required if the rack is designed to hold only one gun or rifle. The barriers 40, 42 provide lateral support for the butts of weapons in the rack and thus they can be any height that provides such support. FIG. 1 depicts the barriers abutting the front wall 26 and the back plate 24 and this is preferred, although not necessary to the present invention, to provide additional mechanical rigidity.

The enclosure 12 mounts to a base 44 with one or more clips or latches 46. The latches 46 provide quick release of the enclosure 12 from the base with the weapons still firmly grasped within the enclosure. The base is preferably screwed, bolted, welded, or otherwise secured to a solid structure such as a vehicle or residence.

FIG. 1 depicts the base 44 horizontally oriented. Alternatively (or additionally), the rack of the present invention may include a base 48 that is oriented vertically. In this case, the enclosure 12 is releasably mounted to the base 48 by one or more latches 50. Those of skill in the art that one feature of the present invention includes the facility to mount the rack either horizontally or vertically and either at the back 14 or the bottom. That is, the base 44 or the base 48 can either be oriented horizontally or vertically, to provide the greatest flexibility in using the present invention where space is available.

The rack of the present invention may also include a cover 50. The cover 50 releasably mounts to the enclosure 12 via latches 52. The cover 50 may also be provided with a carrying handle 54. The cover 50 further includes a gasket 56 made of a soft polymeric material between the cover and the enclosure 12 to make the gun rack at least water proof.

The enclosure is preferably made of a strong lightweight material and, in a preferred embodiment, has been built using extruded aluminum plate that is cut, machined, or stamped and bent into shape. Cast aluminum is believed to be too brittle for this intended application and extruded aluminum provides the desired weight advantage. All of the extruded aluminum members of the enclosure are also plasticized by dipping into liquid plastic to form a tenacious, relatively soft covering for the enclosure. This covering gives a pleasing appearance to the gun rack while eliminating sharp edges of the aluminum. The cover 50 may also be plasticized in the same manner in the same or a contrasting color.

Figure 3:
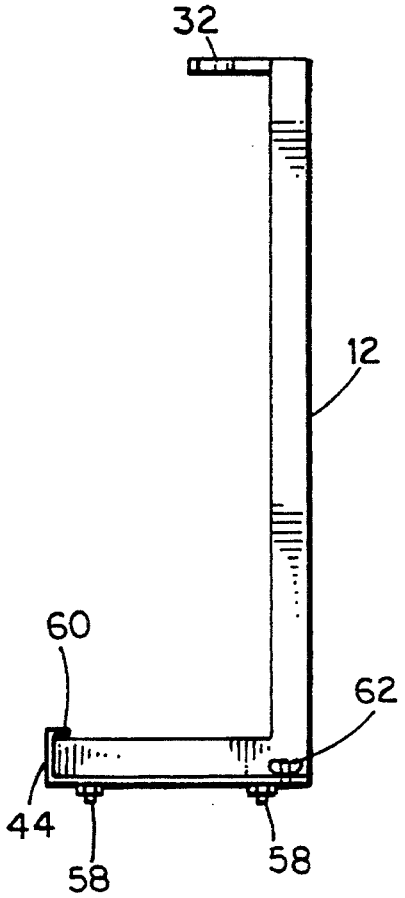
FIG. 3 is a side view of the rack mounted to the base of the present invention in another preferred embodiment.

FIG. 3 depicts a side view of the enclosure mounted to the base in another embodiment. This embodiment, once again, includes an enclosure, 12, a clip member 32, and a base 44, as before. However, in this embodiment, the base is mounted to a foundation with a plurality of bolts 58 that are countersunk into the base to provide a flush profile and thereby stay out of the way of weapons placed within the gun rack. The forward edge of the base 44 forms a lip 60 bent back toward the aft end of the base. The enclosure 12 then slides up under the lip 60 and the enclosure is further secured to the base 44 with one or more wing-nuts 62. Employing the wings-nuts in this manner reduces the cost of construction of the rack and yet provides a solid, secure mounting for enclosure and permits quick and easy removal of the enclosure with the weapons still secured within the gun rack.

Also, additional shock-mounting may be installed, particularly at the points of contact between the lip 60 and the enclosure further reduce vibration of the weapons, but it is believed that plasticizing the extruded aluminum surfaces will provide a double thickness of soft plastic at these points and offers sufficient shock-mounting in all but the worst of conditions.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

I claim:

1. A portable gun rack for firmly supporting a gun in transit, the rack comprising:

a. a base;

b. a portable gun receiving cabinet;

c. means for releasably attaching the cabinet to the base: and d. means within the cabinet for securing a gun.

2. The rack of claim 1 wherein the cabinet comprises an elongated, open-faced box.

3. The rack of claim 1 wherein the cabinet comprises an elongated, open-faced box having a back, a bottom, a pair of opposing sides on either side of the back and bottom, and a rear wall coupled to the back, bottom, and sides, and wherein the means for releasably attaching the cabinet to the base attaches base to the bottom of the cabinet.

4. The rack of claim 1 wherein the cabinet comprises an elongated, open-faced box having a back, a bottom, a pair of opposing sides on either side of the back and bottom, and a rear wall coupled to the back, bottom, and sides, and wherein the means for releasably attaching the cabinet to the base attaches base to the back of the cabinet.

5. The rack of claim 1 further comprising a flexible clip attached to the cabinet arranged to firmly and releasably grasp the barrel of a weapon.

6. The rack of claim 5 wherein the clip is molded of a polymeric material.

7. The rack of claim 1 further comprising a flexible clip attached to the cabinet arranged to firmly and releasably grasp the barrels of a plurality of weapons.

8. The rack of claim 1 further comprising a barrier in the cabinet to prevent the lateral movement of a butt of a weapon placed within the cabinet.

9. The rack of claim 1 wherein the means for releasably attaching the cabinet to the base comprises screw means.

10. The rack of claim 1 wherein the means for releasably attaching the cabinet to the base comprises latch means, manually operable without the aid of a tool.

11. The rack of claim 1 wherein the cabinet is made of extruded aluminum.

12. The rack of claim 1 further comprising a cover and means for releasably attaching the cover to the cabinet.

13. The rack of claim 12 further a comprising weatherproofing gasket between the cover and the cabinet.

14. A method of transporting a weapon in a portable weapon rack comprising a rigid base secured to a vehicle, a portable gun receiving cabinet having a flexible clip arranged to firmly and releasably grasp the weapon, and means for releasably attaching the cabinet to the rigid base, comprising:

a. releasably inserting the weapon into the cabinet;

b. attaching the cabinet to the rigid base;

c. transporting the weapon within the cabinet attached to the rigid base; and d. removing the weapon from the cabinet.

15. The rack of claim 1 wherein the cabinet comprises an elongated, open-faced box having a back, a bottom, a pair of opposing sides on either side of the back and bottom, and a rear wall coupled to the back, bottom, and sides, and wherein the means for releasably attaching the cabinet to the base attaches base to either the bottom or the back of the cabinet.

16. The rack of claim 11 wherein the aluminum is covered with soft plastic.

17. The rack of claim 1 wherein the base includes a horizontally extending lip and a portion of the cabinet slides beneath the lip and wherein the means for releasably attaching the cabinet to the base comprises at least one wing-nut.

18. The rack of claim 1 further comprising a shock mount between the base and the cabinet and a shock mount beneath the base.

* * * * *